US006161397A

United States Patent [19]

McNeil et al.

[11] Patent Number: 6,161,397

[45] Date of Patent: Dec. 19, 2000

[54] INTEGRATED CRYOGENIC AND NON-CRYOGENIC GAS MIXTURE SEPARATION

[75] Inventors: Brian Alfred McNeil, Chessington; Eric William Scharpf, Weybridge; David Graham Winter, Aldershot, all of United Kingdom

[73] Assignee: Air Products and Chemicals, Inc., Allentown, Pa.

[21] Appl. No.: 09/133,145

[22] Filed: Aug. 12, 1998

[51] Int. Cl.[7] ..... F25J 1/00

[52] U.S. Cl. ..... 62/624; 62/920; 62/932

[58] Field of Search ..... 62/624, 920, 932

[56] References Cited

U.S. PATENT DOCUMENTS

| | | | |
|---|---|---|---|
| 3,250,080 | 5/1966 | Garwin | 62/624 |
| 4,595,405 | 6/1986 | Agrawal et al. | 62/18 |
| 4,602,477 | 7/1986 | Lucadamo | 62/24 |
| 4,654,047 | 3/1987 | Hopkins et al. | 62/23 |
| 4,654,063 | 3/1987 | Auvil et al. | 62/18 |
| 4,717,407 | 1/1988 | Choe et al. | 62/624 |
| 4,990,168 | 2/1991 | Sauer et al. | 62/624 |
| 5,832,747 | 11/1998 | Bassett et al. | 62/630 |

FOREIGN PATENT DOCUMENTS

| | | | |
|---|---|---|---|
| 4123689 | 9/1988 | Australia | C01B 3/02 |
| 0359629 | 12/1988 | European Pat. Off. | B01D 53/22 |
| 0307864 | 3/1989 | European Pat. Off. . | |
| 2636543 | 9/1988 | France | B01D 53/02 |
| 3315950 | 3/1984 | Germany . | |
| 4325513 | 12/1994 | Germany | F25J 3/06 |
| 63-247582 | 10/1988 | Japan | F25J 3/08 |
| 2282082 | 5/1993 | United Kingdom | B01D 53/22 |

*Primary Examiner*—Ronald Capossela
*Attorney, Agent, or Firm*—Willard Jones II

[57] ABSTRACT

Gas mixtures are separated by cryogenic separation, preferably a cryogenic condensation separation cycle, into at least a first gas mixture and a second gas mixture having at least one component common with the first gas mixture; at least one gas mixture selected from at least a portion of said feed gas mixture and at least a portion of said second gas mixture is subjected to non-cryogenic separation to provide a separated gas rich in said common component; and said separated gas is added to said first gas mixture to contribute to a product gas mixture. It is particularly preferred to also blend a portion of the second gas mixture with the first gas mixture to facilitate, in conjunction with the separated stream, simultaneous control of both the amount and composition of the first gas mixture product. The process has particular application to the separation of a gas containing primarily hydrogen and carbon monoxide to provide a product gas which consists primarily of hydrogen and carbon monoxide in a molar ratio different from that of the feed gas.

38 Claims, 7 Drawing Sheets

INTEGRATED CRYOGENIC AND NON-CRYOGENIC GAS MIXTURE SEPARATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to the cryogenic separation of a feed gas mixture to provide at least one product gas mixture having a different composition from the feed mixture and has particular, but not exclusive application, to providing a product gas mixture containing a desired molar ratio of hydrogen and carbon monoxide from a gaseous feed, especially syngas, containing them in a different molar ratio.

Syngas is a gaseous mixture consisting primarily of hydrogen and carbon monoxide which, depending upon the level of purity, can contain small amounts of argon, nitrogen, methane and other trace hydrocarbon impurities. Usually, it is obtained by catalytic conversion or partial oxidation of coal, coke, natural gas, or other hydrocarbon feeds. The primary uses of syngas are in the synthesis of methanol (requiring hydrogen:carbon monoxide molar ratio of 2:1) and in reactions to produce oxo-alcohols (requiring hydrogen:carbon monoxide molar ratio of at least 1:1). For many of these applications, it is necessary to control the relative proportions of hydrogen and carbon monoxide. This is achieved by, for example cryogenically separating crude syngas into hydrogen-rich and carbon monoxide-rich product streams and then combining them in the appropriate molar ratio to produce the required syngas composition. The level of impurities, especially methane and other hydrocarbons, in the crude syngas usually also is reduced during the cryogenic separation.

It is known to integrate cryogenic and membrane separation techniques to separate feed gas mixtures but in the prior art the membrane separation is used to enrich the feed stream to the cryogenic separation . In the case of syngas separation, the prior art integration exclusively uses hydrogen permeation membranes to provide carbon monoxide-enriched feed or recycle streams for feeding to the cold box of the cryogenic separation.

U.S. Pat. No. 4,595,405 (R. Agrawal & S. Auvil; 1986) describes a separation process in which a gas stream from a cryogenic separation is subjected to a membrane separation and at least some of the discharge gas from the membrane separation is recycled to the cryogenic separation. The process is exemplified by the separation of air (or other feed gas mixture of nitrogen and oxygen) to produce gaseous and/or liquid nitrogen in which an oxygen-enriched stream from the cryogenic separation is subjected to the membrane separation to provide an oxygen-rich permeate stream and a nitrogen-enriched recycle stream.

U.S. Pat. No. 4,654,063 (S. Auvil & R. Agrawal; 1987) describes integration of a membrane separation with a cryogenic or other non-membrane separation to recover hydrogen from a feed gas mixture. The membrane separation is used to remove hydrogen from the feed to the non-membrane separation and/or from a hydrogen enriched stream produced in the non-membrane separation prior to recycle of the resultant hydrogen-lean stream to the non-membrane separation.

U.S. Pat. No. 4,654,047 (J. Hopkins et al.; 1987) describes a process for obtaining hydrogen from a feed gas in which the feed gas is subjected to membrane separation upstream of cryogenic separation to provide a hydrogen-lean feed to the cryogenic separation. A hydrogen-rich stream from the cryogenic separation is recycled to the membrane to recover additional hydrogen as product.

JP-A-63-247582 (Y. Tomisaka; 1988) describes a process to separate carbon monoxide from feed containing predominantly carbon monoxide and hydrogen in which the feed is subjected to a membrane separation immediately upstream of a cryogenic separation to raise the concentration of carbon monoxide in the gas fed to the cryogenic separation.

FR-A-2 636 543 (P. Gauthier & C. Monereau; 1990) describes an integrated system for producing ammonia synthesis gas (hydrogen & nitrogen) in which a membrane separation removes excess hydrogen upstream of a cryogenic purification system. Only the gas feed to the cryogenic system is processed by the membrane.

EP-A-0 359 629 (P. Gauthier; 1990; see also corresponding AU-A-41236/89) describes the use of a permeator to remove excess hydrogen from a syngas to adjust the $H_2$:CO molar ratio prior to feeding to a cryogenic separation for the production of hydrogen and carbon monoxide.

DE-A-43 25 513 (R. Fabian; 1994) describes a process for recovery of a high purity carbon monoxide product stream and a hydrogen product stream using a membrane integrated with a cryogenic partial condensation cycle. An intermediate syngas stream is passed through a membrane to remove hydrogen before the stream is recycled to the cryogenic system to recover and purify the carbon monoxide product. The claimed benefit relative to a traditional condensation cycle is the elimination of the cold heat exchanger and hydrogen expansion refrigeration system.

GB-A-2 282 082 (J. Gilron & A. Soffer; 1995) describes integration of a membrane directly into a cryogenic process with the membrane itself run at cryogenic temperatures. The stated advantage is the elimination of the thermodynamically inefficient process of warming a gas stream from the cryogenic unit, passing it through the membrane at ambient conditions, and recooling the membrane discharge gas for further cryogenic processing. Specific focus is toward improving the membrane-cryogenic integrations described in U.S. Pat. No. 4,654,063 and U.S. Pat. No. 4,595,405.

The prior art integration of cryogenic and membrane separation techniques in syngas separation (in which hydrogen permeation membranes provide carbon monoxide-enriched feed or recycle streams to the cryogenic separation) improves overall efficiency and/or capacity of the cryogenic separation but does not address the growing complexity and control required of new syngas processing facilities. Recently there has been an increasing demand for simultaneous production of carbon monoxide, hydrogen, and one or more hydrogen/carbon monoxide products under varying feed composition and product slate scenarios. The present invention is targeted toward such simultaneous production requirements. In particular, it is an objective of this invention to improve the control and versatility of gas mixture separation processes using cryogenic separation to produce a gas mixture product of different composition to the feed gas mixture. More particularly, it is an objective of the invention to provide a separation process which is capable of improving the control and versatility of a cryogenic condensation separation of syngas to produce carbon monoxide, hydrogen and one or more hydrogen/carbon monoxide gas mixture products through the integration of a product (and optional feed conditioning) membrane.

BRIEF SUMMARY OF THE INVENTION

The objectives of the invention can be achieved by conducting membrane or other non-cryogenic separation on the feed gas mixture and/or on a gas mixture discharge stream from the cryogenic separation to provide a stream rich in a component ("the common component") of a primary product stream from the cryogenic separation and blending the separated stream with the primary product stream to control its composition. The gas discharge stream can be a portion of a further product stream from the cryogenic separation. Additional control of the process can be provided by blending a portion of the feed gas mixture with the primary product stream and/or by subjecting the feed gas (portion) to membrane separation upstream of the cryogenic separation to alter the composition of the feed prior to the cryogenic separation. It is particularly preferred to also blend a portion of the gas discharge stream with the primary product stream to facilitate, in conjunction with the separated stream, simultaneous control of both the amount and composition of the primary product. The present invention retains the advantage of cryogenic separation in removing heavy contaminant(s), such as methane in the case of syngas separation, from the feed gas mixture.

As used in this application, the term "cryogenic separation" means that a gas mixture is separated by a separation process, for example condensation and/or fractionation, operating with a minimum temperature below the temperature required to condense the common component from said gas mixture. Usually, said minimum temperature will be below −60° F. (−50° C.), preferably below −150° F. (−100° C.).

DETAILED DESCRIPTION OF THE INVENTION

Figure 1:
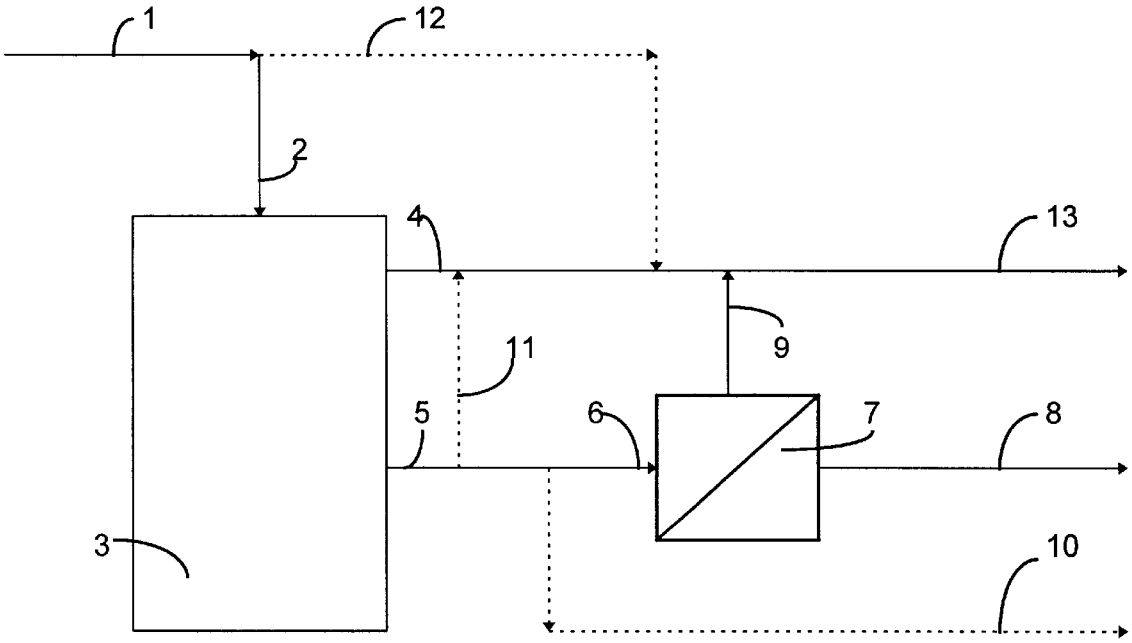
FIG. 1 is a schematic representation of an embodiment of the present invention in which the stream subjected to non-cryogenic separation is a discharge stream from the cryogenic separation.

According to a first aspect, the present invention provides a process for the separation of a feed gas mixture to provide at least one product gas mixture, wherein:

at least a part of the feed gas mixture is separated by cryogenic separation into at least a first gas mixture and a second gas mixture having at least one component common with the first gas mixture;

at least one gas mixture selected from the group consisting of at least a portion of said feed gas mixture and at least a portion of said second gas mixture is subjected to non-cryogenic separation to provide a separated gas rich in said common component; and said separated gas is added to said first gas mixture to contribute to said product gas mixture.

In a second aspect, the present invention provides an apparatus for the separation by the process of the first aspect of a feed gas mixture to provide at least one product gas mixture, comprising:

a cryogenic separator constructed and arranged to separate at least a part of the feed gas mixture into at least a first gas mixture and a second gas mixture having at least one component common with the first gas mixture;

a non-cryogenic separator constructed and arranged to separate at least one gas mixture selected from the group consisting of at least a portion of said feed gas mixture and at least a portion of said second gas mixture to provide a separated gas enriched in said common component; and a conduit assembly constructed and arranged to add said separated gas to said first gas mixture.

The invention has particular, but not exclusive, application to the separation of a feed gas mixture into first and second gas mixtures which are primarily mixtures of the same two components in different molar ratios. It is especially applicable to the separation of a feed gas mixture comprising hydrogen and carbon monoxide in which the cryogenic separation produces mixtures consisting primarily of hydrogen and carbon monoxide, and the common component is carbon monoxide. In such an embodiment, the first hydrogen/carbon monoxide mixture has a lower $H_2$:CO molar ratio than the second hydrogen/carbon monoxide mixture and reduced heavy contaminant(s) concentration than the feed gas mixture. The term "primarily" used herein in respect of product streams means that the specified component(s) constitute at least 95, preferably at least 99, mole percent, of the stream. When used in respect of feed gas mixtures, "primarily" means that the specified component(s) constitute at least 90, preferably at least 95 and more preferably at least 99, mole percent, of the stream.

Usually, the non-cryogenic separator will be a membrane separator. However, other non-cryogenic separators can be used. For example, a pressure or vacuum swing adsorption process or osmotic separation could be used. Accordingly, references in this application to membrane separation are intended to refer to non-cryogenic separation generally unless it is clear from the context that reference to membrane separation is specifically intended.

The membrane separated (e.g. CO-rich) gas can be obtained by membrane separation of all or, more usually, only a portion of the second (e.g. higher $H_2$:CO molar ratio) gas mixture. Additionally or alternatively, the membrane separated gas can be obtained by membrane separation of all, or more usually, only a portion of the feed gas mixture. However, it is presently preferred that the membrane separated gas is obtained either from a portion of the second gas mixture or from a portion of the feed gas mixture.

Regardless of the source of the membrane-separated gas, it is preferred that a portion of the second gas mixture, other than the portion (if any) of the second gas mixture subjected to the membrane separation, is added to the first (e.g. lower $H_2$:CO molar ratio) gas mixture to facilitate control of both amount and concentration of the resultant product gas mixture. Additionally or alternatively, a portion of the feed gas mixture, other than the portion (if any) of the feed gas mixture subjected to the membrane separation, can be added to the first gas mixture.

Preferably, the cryogenic separation comprises partially condensing at least a portion of the feed gas stream to provide a vapor phase and a liquid phase; one (i) of the first and second gas mixtures is obtained from this liquid phase; and the other (ii) of the first and second gas mixtures is obtained from this vapor phase. Heavy contaminant(s) in the feed gas mixture are concentrated in the liquid phase and, accordingly, the vapor phase has reduced heavy contaminant (s) concentration. Especially when the feed gas mixture contains a heavy impurity to be excluded from both the first and second gas mixtures, the liquid phase can be partially vaporized to provide a residual liquid phase and a vaporized phase; this residual liquid phase fractionated to provide a gaseous stream enriched in lighter component(s) and a liquid stream enriched in heavier component(s); and said one (i) of the first and second gas mixtures derived from the vaporized phase and the gaseous stream. The liquid stream usually will be further processed in the cryogenic separation to remove the heavy impurity from the main component of the liquid stream. In the $H_2$:CO system, the vapor phase is of increased $H_2$ concentration (compared with the feed); the liquid phase is of increased CO concentration (compared with the feed); the first (lower $H_2$:CO molar ratio) gas mixture is obtained from the liquid phase and the second (higher $H_2$:CO molar ratio) gas mixture is obtained from the vapor phase; $H_2$ is the lighter component of the gaseous stream and carbon monoxide is the heavier component of the liquid stream and methane is the heavy impurity.

Refrigeration for the cryogenic separation can be provided in any conventional manner, such as by liquid nitrogen provided from an external source or by expansion of a portion of the vapor phase of the partially condensed feed gas mixture or other suitable process vapor stream.

In one presently preferred embodiment, the invention provides a process for the separation of a feed gas mixture containing hydrogen and carbon monoxide to provide at least one product gas mixture containing hydrogen and carbon monoxide in a different molar ratio to said feed gas mixture, wherein:

at least a portion of the feed gas mixture is cryogenically separated by partial condensation to provide a hydrogen-enriched vapor phase and a carbon monoxide-enriched liquid phase; a first gas mixture containing hydrogen and carbon monoxide in a first ($H_2$:CO) molar ratio is obtained from said carbon monoxide-enriched liquid phase and a second gas mixture containing hydrogen and carbon monoxide in a higher ($H_2$:CO) molar ratio (than said first gas mixture) is obtained from said hydrogen-enriched vapor phase;

at least a portion of said second gas mixture is subjected to non-cryogenic membrane separation to provide a carbon monoxide-rich gas; and said carbon monoxide-rich gas is added to said first gas mixture to contribute to said product gas mixture.

In the corresponding apparatus aspect, an apparatus for the separation by the process of said preferred embodiment of a feed gas mixture containing hydrogen and carbon monoxide to provide at least one product gas mixture containing hydrogen and carbon monoxide in a different molar ratio to said feed gas mixture, comprises:

a heat exchanger constructed and arranged to partially condense at least a portion of the feed gas mixture in a cryogenic cold box to provide a hydrogen-enriched vapor phase and a carbon monoxide-enriched liquid phase;

a phase separator constructed and arranged to separate said vapor and liquid phases;

a first processing assembly constructed and arranged to obtain from said liquid phase a first gas mixture containing hydrogen and carbon monoxide in a first ($H_2$:CO) molar ratio;

a second processing assembly constructed and arranged to obtain from said vapor phase a second gas mixture containing hydrogen and carbon monoxide in a higher ($H_2$:CO) molar ratio (than said first gas mixture);

a non-cryogenic separator constructed and arranged to separate at least a portion of said second gas mixture to provide a carbon monoxide-rich gas; and a conduit assembly constructed and arranged to add said carbon monoxide-rich gas to said first gas mixture.

In another presently preferred embodiment, the invention provides a process for the separation of a feed gas mixture containing hydrogen and carbon monoxide to provide at least one product gas mixture containing hydrogen and carbon monoxide in a different molar ratio to said feed gas mixture, wherein:

at least a portion of the feed gas mixture is cryogenically separated by partial condensation to provide a hydrogen-enriched vapor phase and a carbon monoxide-enriched liquid phase; a first gas mixture containing hydrogen and carbon monoxide in a first ($H_2$:CO) molar ratio is obtained from said carbon monoxide-enriched liquid phase and a second gas mixture containing hydrogen and carbon monoxide in a higher ($H_2$:CO) molar ratio (than said first gas mixture) is obtained from said hydrogen-enriched vapor phase;

at least a portion of said feed gas mixture is subjected to non-cryogenic membrane separation to provide a carbon monoxide-rich gas; and said carbon monoxide-rich gas is added to said first gas mixture to contribute to said product gas mixture.

In the corresponding apparatus aspect, an apparatus for the separation by the process of said another preferred embodiment of a feed gas mixture containing hydrogen and carbon monoxide to provide at least one product gas mixture containing hydrogen and carbon monoxide in a different molar ratio to said feed gas mixture, comprises:

a heat exchanger constructed and arranged to partially condense at least a portion of the feed gas mixture in a cryogenic cold box to provide a hydrogen-enriched vapor phase and a carbon monoxide-enriched liquid phase;

a phase separator constructed and arranged to separate said vapor and liquid phases;

a first processing assembly constructed and arranged to obtain from said liquid phase a first gas mixture containing hydrogen and carbon monoxide in a first ($H_2$:CO) molar ratio;

a second processing assembly constructed and arranged to obtain from said vapor phase a second gas mixture containing hydrogen and carbon monoxide in a higher ($H_2$:CO) molar ratio (than said first gas mixture);

a non-cryogenic separator constructed and arranged to separate at least a portion of said feed gas mixture to provide a carbon monoxide-rich gas; and a conduit assembly constructed and arranged to add said carbon monoxide-rich gas to said first gas mixture.

The following discussion is with reference to the application of the invention to separation of syngas but it will be understood that the invention is not restricted to such application but can be used for the separation of, for example, feed gas providing ammonia synthesis gas or feed gas providing synthetic air.

The membrane integration of the invention improves the versatility of the overall plant to produce varying syngas product flows and compositions depending on production requirements. It is also possible to provide a fixed flow of more valuable syngas product streams in the face of varying feed gas compositions. The process can be adapted to make syngas product of any commonly used $H_2$:CO molar ratio and can be used to make multiple syngas products. Further, it can also be applied to methane wash cold box cycles.

In addition, the membrane integration facilitates high carbon monoxide recovery without a traditional cold end cryogenic subsystem. Usually, prior art cryogenic separation of syngas produces a crude hydrogen stream by cryogenically condensing and removing carbon monoxide through vapour-liquid separation at temperatures as low as −335° F. (−205° C.). At temperatures below about −320° F. (−196° C.), nitrogen can not be used to purge the insulation space in the cryogenic apparatus and more expensive purge options such as the use of vacuum or hydrogen must be used. Since this invention can generate the corresponding crude hydrogen stream from the membrane permeate, no expensive, power consuming, cryogenic cold end is needed.

Usually, the process of the invention will commence with pre-processing a crude gas stream containing hydrogen and carbon monoxide in any of various known ways to remove water vapor and assorted acid gases including carbon dioxide, hydrogen sulfide, and other sulfur containing species. The intermediate crude gas product from these upstream processing units typically contains hydrogen and carbon monoxide with nitrogen, argon, methane and other hydrocarbons as impurities. This pre-processed stream is then fed to the integrated membrane/cryogenic separation and purification system to generate the final products of carbon monoxide, hydrogen, methane, fuel gas, and various syngas blends of these species.

The invention is primarily focussed toward condensation cycles with syngas co-production, which reduces heavy contaminant(s) concentration in the product gas mixture(s). Methane wash cycles could be used but, by their nature, often result in much higher methane concentration(s) in the syngas product(s). This can either be tolerated in the syngas product or the streams which feed the syngas generation separator can be stripped of methane by other processes within the cold box. The invention is also applicable to any typically required $H_2$:CO ratio syngas product and to multiple syngas co-product generation depending on the system requirements.

In the embodiment of the invention schematically represented in FIG. 1, a syngas feed 1 containing primarily hydrogen and carbon monoxide provides the feed 2 to a cryogenic separation unit 3 in which it is separated to provide at least a crude primary syngas product stream 4 and a crude secondary syngas product stream 5 having a higher hydrogen concentration than the crude primary product 4. Other streams exiting the cryogenic separation unit are not shown. The crude secondary product stream 5 provides the feed 6 to a membrane separation unit 7 having a hydrogen-permeable membrane which separates the stream into a $H_2$-rich permeate 8 and a CO-enriched residual stream 9. The residual stream 9 is blended with the crude primary syngas product stream. Usually, only a portion of the crude secondary syngas product stream 5 will be fed to the membrane separator 7 and at least a portion 10 of the remainder of that stream will by-pass the membrane separator to provide a secondary syngas product. Alternatively or, more usually, additionally, at least a portion 11 of the remainder of the crude secondary syngas product stream will be blended with the crude primary syngas product stream 4. Optionally, a portion 12 of the syngas feed 1 by-passes the cryogenic separation unit 3 and is blended with the crude primary syngas product stream 4. The order of addition of the streams 9, 11 and 12 to the crude primary syngas product stream 4 can vary from those shown in FIG. 1 and the amounts of those streams will be controlled to provide the required composition and volume of the resultant primary syngas product stream 13.

Figure 2:
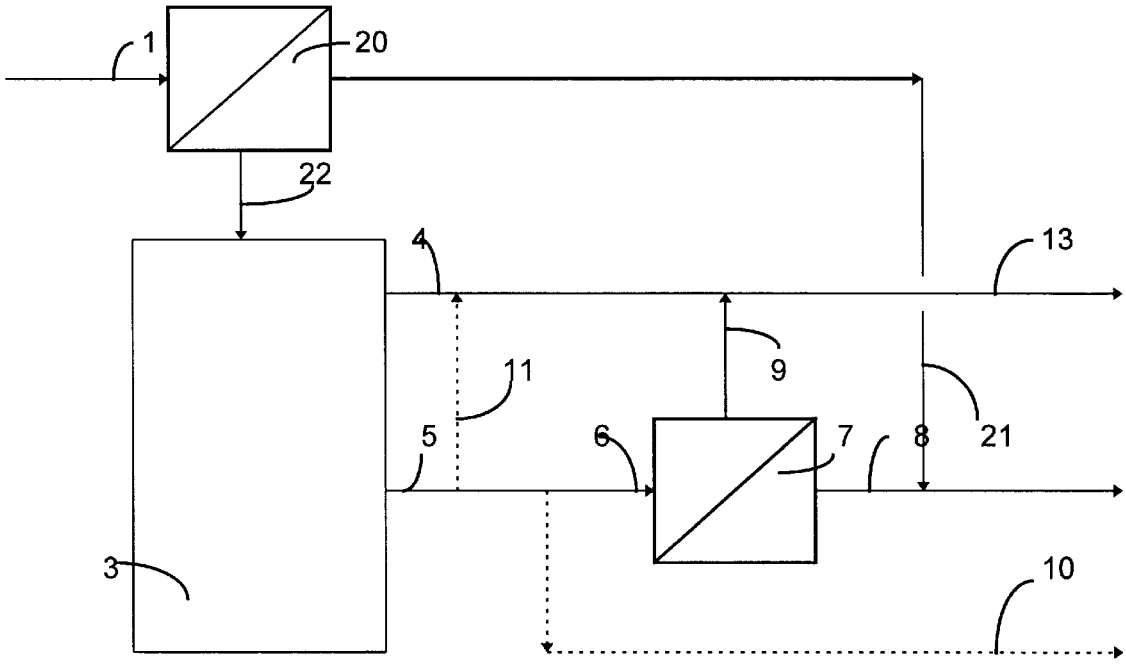
FIG. 2 is a schematic representation of an embodiment of the present invention in which the stream subjected to non-cryogenic separation is a discharge stream from the cryogenic separation and feed gas mixture is subjected to membrane separation upstream of the cryogenic separation.

The embodiment of the invention schematically represented in FIG. 2 differs from that of FIG. 1 in that the syngas feed 1 is fed to a second membrane separation unit 20 upstream of the cryogenic separation unit 3. This membrane separation unit 20 has a hydrogen-permeable membrane which separates the feed into a $H_2$-rich permeate stream 21 and a $H_2$-lean residual stream 22. The $H_2$-rich permeate stream 21 is blended with the $H_2$-rich permeate stream 8 from the membrane separation unit 7 and the $H_2$-lean residual stream 22 provides the feed to the cryogenic separation unit 3. The order of addition of the streams 9 and 11 to the crude primary syngas product stream 4 can vary from those shown in FIG. 2 and the amounts of those streams will be controlled to provide the required composition and volume of the resultant primary syngas product stream 13.

Figure 3:
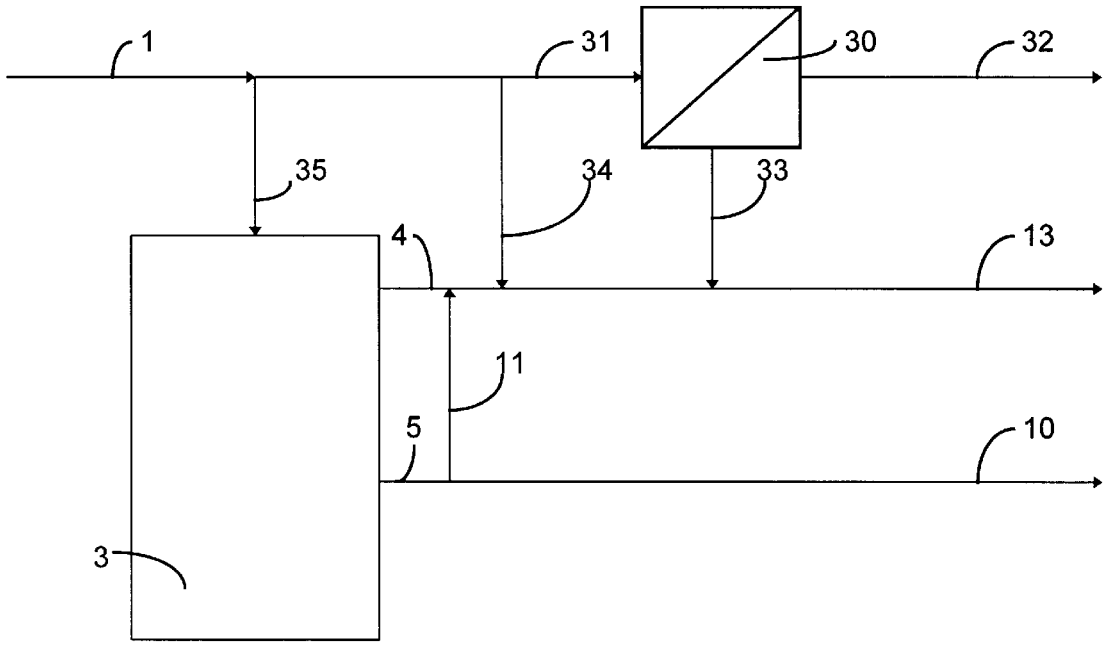
FIG. 3 is a schematic representation of an embodiment of the present invention in which the stream subjected to non-cryogenic separation is a portion of the feed gas mixture.

The embodiment of the invention schematically represented in FIG. 3 differs from that of FIG. 1 in that the crude secondary syngas product 5 only provides the optional stream 11 for blending with the crude primary syngas product 4 and the membrane separation unit 7 is replaced by a membrane separation unit 30 which separates a portion 31 of the syngas feed 1 to provide a $H_2$-rich permeate stream 32 and a CO-enriched residual stream 33. The residual stream 33 is blended with the crude primary syngas product stream 4. Optionally, another portion 34 of the synthesis feed gas is blended directly with the crude primary syngas product stream. The remainder 35 of the syngas feed 1 is fed to the cryogenic separation unit 3. The order of addition of the streams 11, 33 and 34 to the crude primary syngas product stream 4 can vary from those shown in FIG. 3 and the amounts of those streams will be controlled to provide the required composition and volume of the resultant primary syngas product stream 13.

Figure 4:
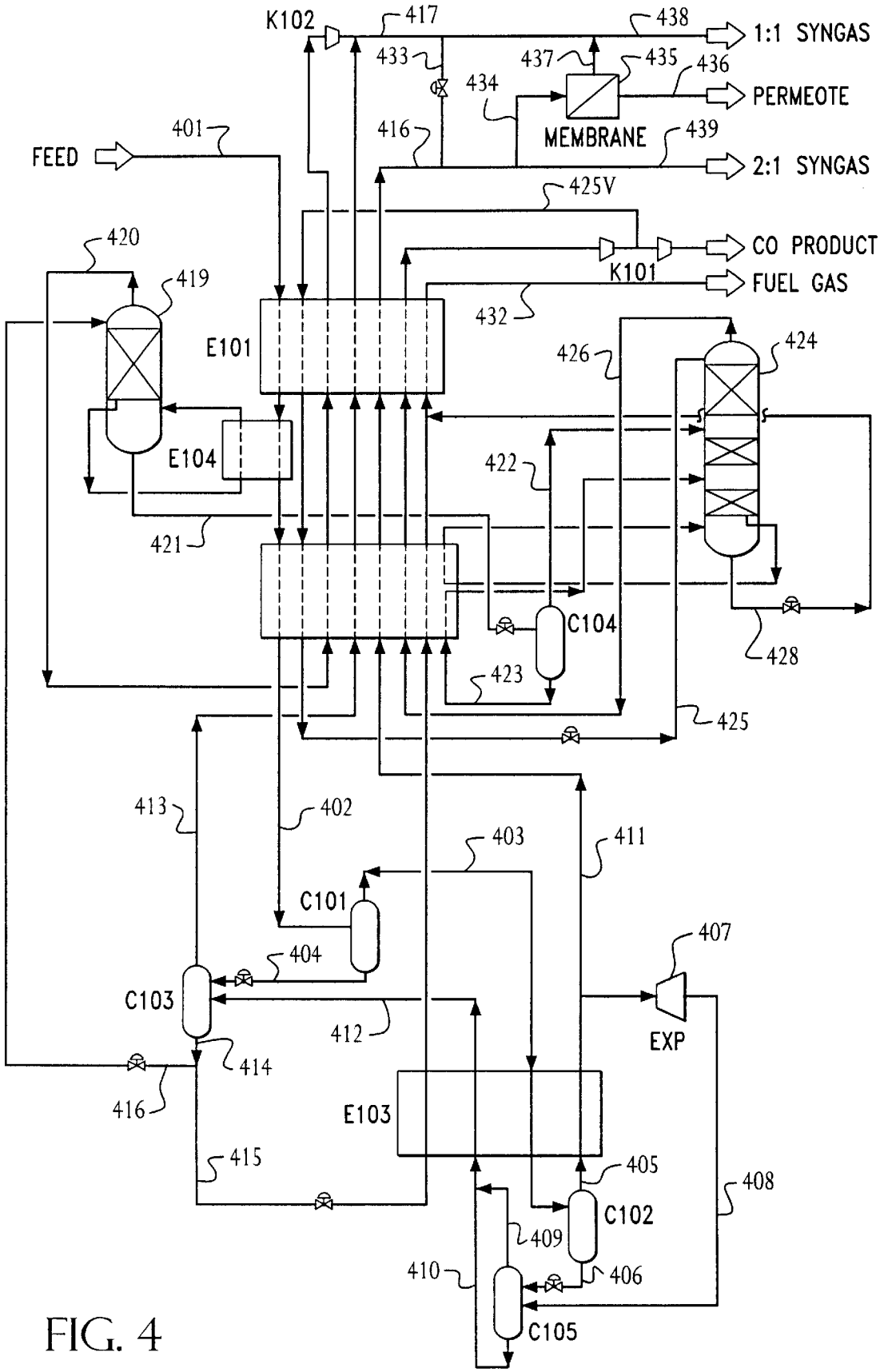
FIG. 4 is a simplified process flow diagram of a process of the embodiment of the FIG. 1 for producing two gas mixture products consisting primarily of hydrogen and carbon monoxide with different $H_2$:CO molar ratios from a syngas feed containing hydrogen and carbon monoxide and contaminated with methane.
Figure 5:
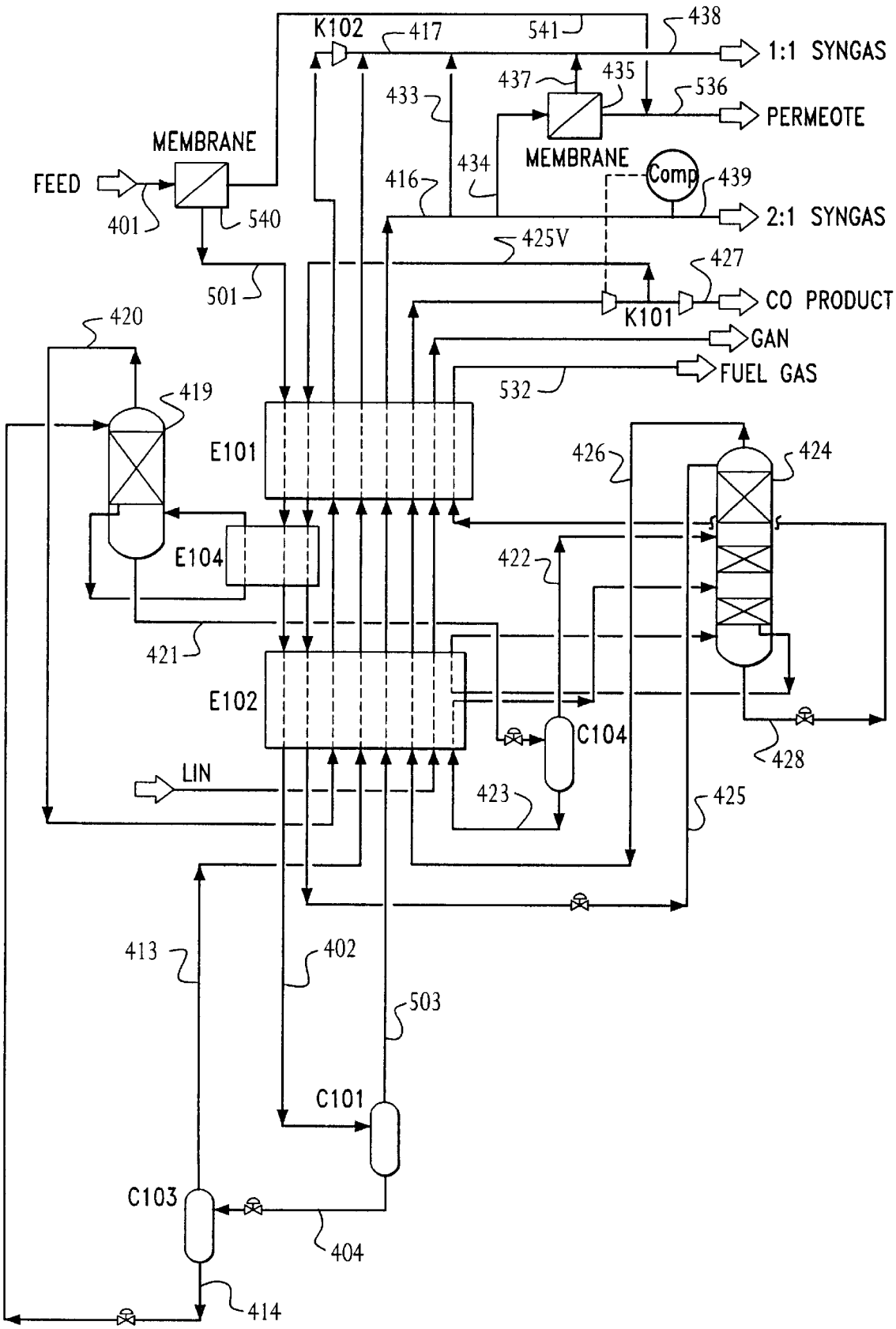
FIG. 5 is a simplified process flow diagram of a process of the embodiment of the FIG. 2 for producing two gas mixture products consisting primarily of hydrogen and carbon monoxide with different $H_2$:CO molar ratios from a syngas feed containing hydrogen and carbon monoxide and contaminated with methane.
Figure 6:
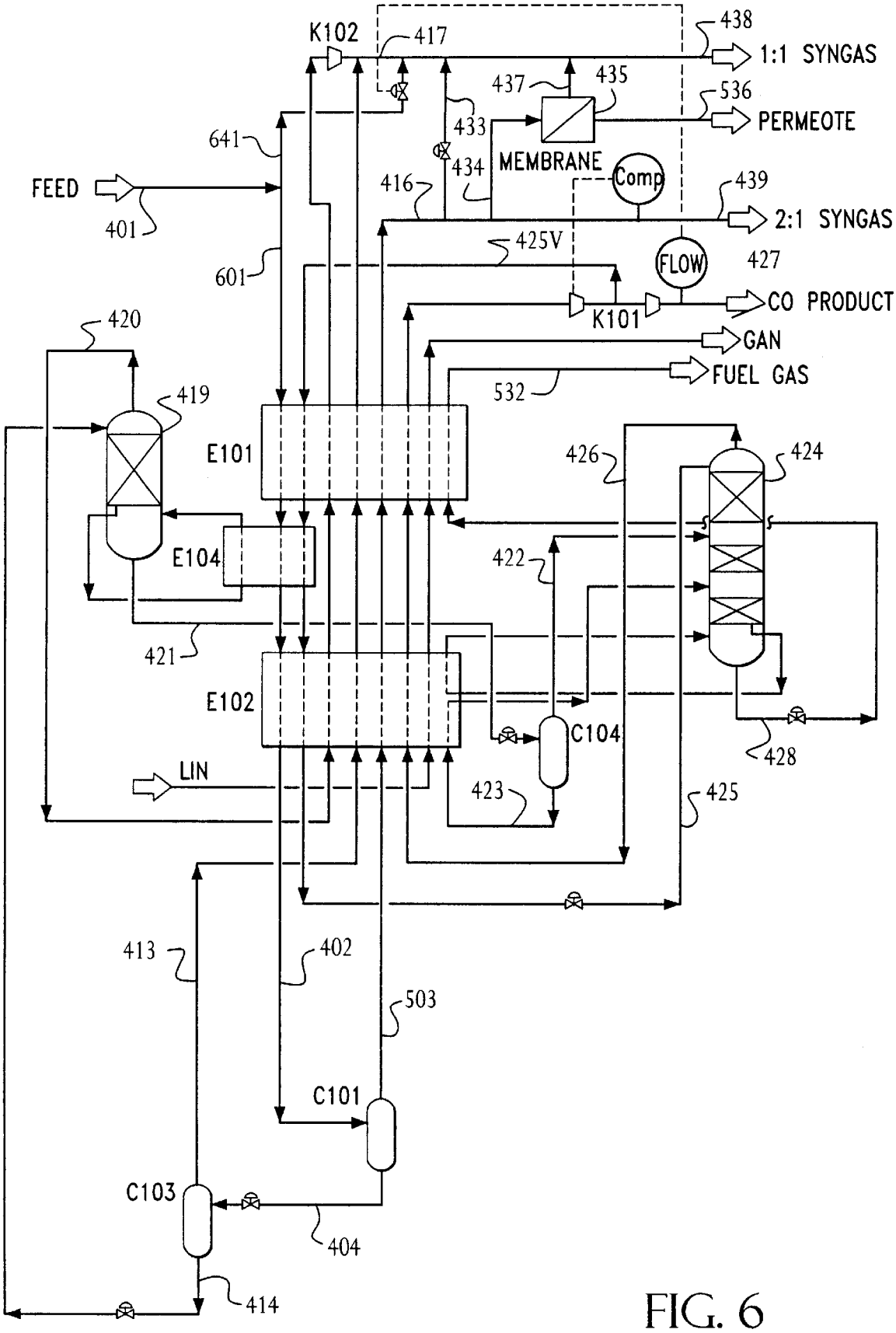
FIG. 6 is a simplified process flow diagram of another process of the embodiment of the FIG. 1 for producing two gas mixture products consisting primarily of hydrogen and carbon monoxide with different $H_2$:CO molar ratios from a syngas feed containing hydrogen and carbon monoxide and contaminated with methane.
Figure 7:
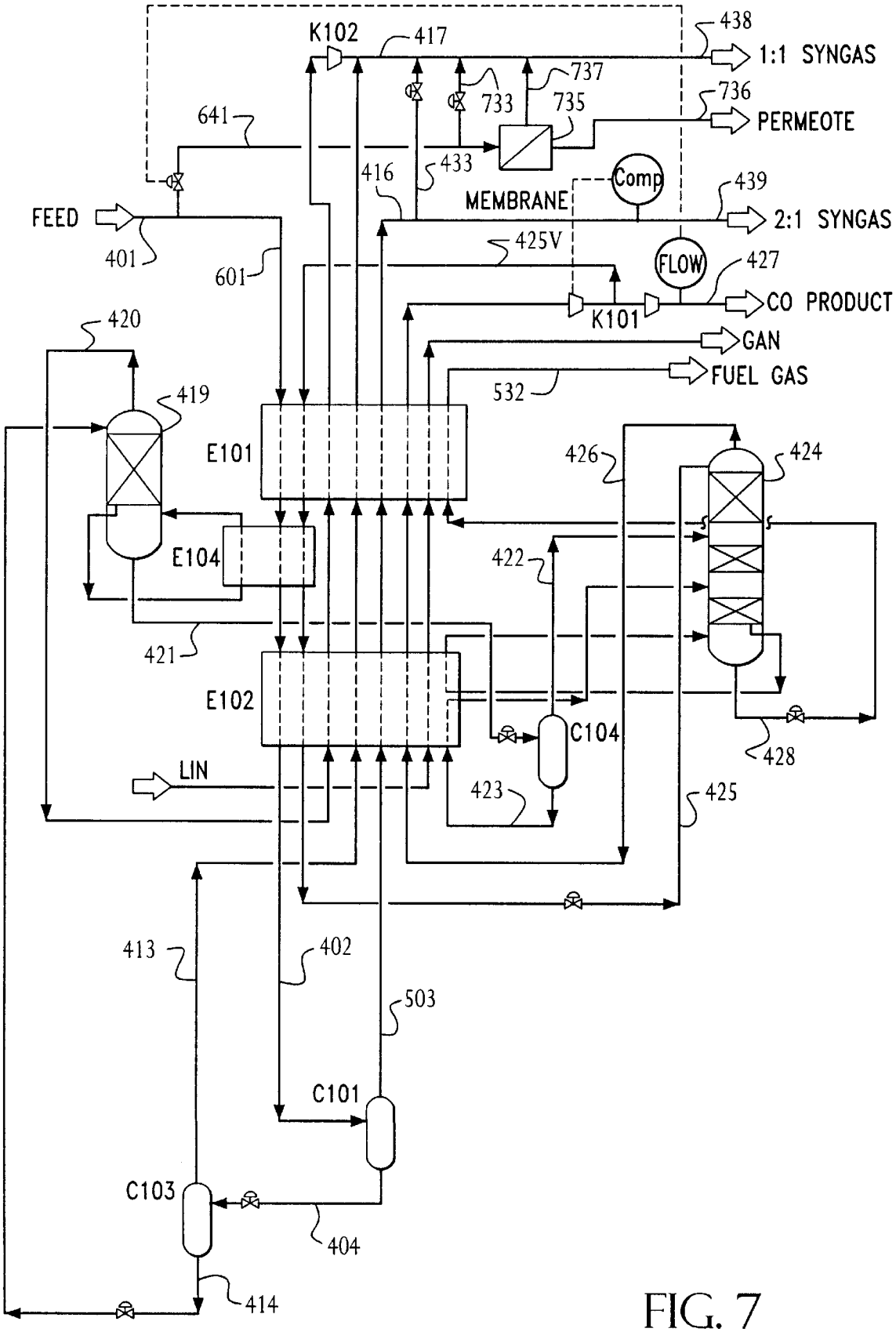
FIG. 7 is a simplified process flow diagram of a process of the embodiment of the FIG. 1 for producing two gas mixture products consisting primarily of hydrogen and carbon monoxide with different $H_2$:CO molar ratios from a syngas feed containing hydrogen and carbon monoxide and contaminated with methane.

The simplified process flow diagrams of FIGS. 4 to 7 show applications of the invention in various forms with condensation cycle cold boxes to produce carbon monoxide and both 1:1 and 2:1 $H_2$:CO nominal syngas products. FIG. 4 shows an embodiment of the invention with an expander refrigerated cycle, while FIGS. 5, 6 and 7 show liquid nitrogen (LIN) refrigerated systems. The differences between FIGS. 5, 6, and 7 center on the use of an auxiliary feed membrane, cold box feed bypass control of carbon monoxide production, and generation of the carbon monoxide-rich control stream by permeation of $H_2$ from a second cold box bypass stream respectively. The details of the different condensation cycles in FIGS. 4 to 7 can be changed provided that the cold box generates a relatively $H_2$-rich stream and a crude syngas product stream.

The key aspect of the cryogenic separation to the invention as applied to syngas separation is its production of both the relatively $H_2$-rich gas stream and at least a portion of the crude syngas product stream. Further, an important aspect is the reduction of methane concentration in the product gas mixture stream(s). In FIGS. 4–7, this relatively $H_2$-rich stream is the 2:1 $H_2$:CO product syngas stream and the primary syngas product is the 1:1 $H_2$:CO product syngas stream. A portion of the relatively $H_2$-rich gas stream is used in the illustrated embodiments to provide part of the control to the primary syngas product stream through blending to increase its $H_2$:CO ratio as needed. The key aspect of the membrane separation is to take a portion of the $H_2$-rich stream (or optionally a portion of the feed stream to the cryogenic separation) and remove hydrogen to create a relatively CO-rich stream. This stream must have an $H_2$:CO molar ratio lower than the primary syngas product since it is then blended to control the syngas product stream to decrease its $H_2$:CO molar ratio as needed. The total flow of the syngas product stream can be increased by increasing the flow of the $H_2$-rich stream and correspondingly increasing the CO-rich stream flow from the membrane separation to maintain the syngas $H_2$:CO ratio at the desired level only now at an increased flow. These control flows can be similarly decreased to produce the opposite effect.

The primary syngas product stream (1:1 syngas) and the $H_2$-rich syngas stream (2:1 syngas) may have a variety of compositions and pressures. Ideally, the pressure of the $H_2$-rich stream should be at least 10 psi (70 kPa) higher than the primary syngas product stream. A compressor could be added if this is not the case. Subject to the $H_2$:CO molar ratio of the $H_2$-rich stream being higher than that of the primary syngas product stream, both streams usually will have a $H_2$:CO molar ratio between about 0.5 and about 5 with methane, nitrogen, argon and other trace impurities.

Referring to FIG. 4, crude syngas is supplied at, for example, about 800 psig (5.5 MPag) and 50° F. (10° C.) to a hydrogen/carbon monoxide ("HYCO") cold box via supply conduit 401. The crude gas has been preprocessed in conventional manner to remove water vapor and acid gases such as carbon dioxide, hydrogen sulfide and other sulfur-containing species and contains primarily hydrogen and carbon monoxide contaminated with argon, nitrogen, methane and other trace hydrocarbon impurities.

The feed stream 401 is cooled and partially condensed by passage through heat exchangers E101, E104 and E102. The partially condensed feed 402 is fed to first phase separator pot C101 to provide a first vapor stream 403 and first liquid stream 404. The first vapor stream 403 is further cooled and partially condensed in heat exchanger E103 and fed to second phase separator pot C102 in which is it separated into a second vapor stream 405 and a second liquid stream 406.

The second vapor stream 405 is rewarmed in heat exchanger E103 and a portion thereof expanded in expander 407 to provide refrigeration for the cold box. The expanded and, usually, partially condensed, stream 408 is fed to third phase separator pot C105, into which the second liquid stream 406 also is flashed. Third vapor stream 409 and third liquid stream 410 are withdrawn from the third phase separator pot C105 and combined. The remainder 411 of the rewarmed second vapor stream is further rewarmed in heat exchangers E402 and E 401 to provide a relatively $H_2$-rich crude secondary syngas product stream 416.

The mixture resulting from combining the third vapor stream 409 and third liquid stream 410 is warmed in heat exchanger E103 to provide a partially vaporized stream 412, which is fed to fourth phase separator pot C103. The first liquid stream 404 also is flashed into the separator C103. Fourth vapor stream 413 and fourth liquid stream 414 are withdrawn from the separator C103. The fourth vapor stream 413 is warmed in heat exchangers E102 and E101 to provide the major portion of a relatively $H_2$-lean crude primary syngas product 417 at, for example, about 500 psig (3.5 MPag).

If excess carbon monoxide is present, a portion 415 of the fourth liquid stream 414 can be split off, let down in pressure and rewarmed in heat exchangers E103 and E102 before being combined with methane-enriched liquid bottoms 428 from a methane-separation column 424 described below, for further rewarming in E101 and discharged as fuel 432.

The remainder 418 of the fourth liquid stream 414 is flashed into hydrogen stripping column 419 to provide a hydrogen-enriched vapor overhead 420 and carbon monoxide-enriched liquid bottoms 421. The column 419 operates at, for example, about 285 psig (1.95 MPag) and is reboiled against, for example, cooling crude syngas feed 401 in heat exchanger E104.

The overhead 420 from the column 419 is rewarmed in heat exchangers E102 and E101, compressed in a compressor K102 and then combined with warmed vapor stream 413 to contribute to the crude primary syngas product stream 417.

The liquid bottoms 421 are flashed into phase separator C104 from which vapor and liquid streams 422 and 423 respectively are withdrawn. The vapor stream 422 is fed directly to an intermediate location of the methane separation column 424. The liquid stream 423 is vaporized in heat exchanger E102 and fed to a lower intermediate location of the column 424. The column 424 is refluxed by carbon monoxide heat pump stream 425 and reboiled in heat exchanger E102 against the crude syngas feed 401 and the heat pump stream 425. The methane separation column 424 operates at, for example, about 160 psig (1.1 MPag).

Carbon monoxide overhead 426 from column 424 is warmed in heat exchangers E102 and E101 and compressed in compressor K101. The carbon monoxide heat pump vapor stream 425V is withdrawn from an intermediate stage of the compressor K101 and a carbon monoxide product 427 is withdrawn from the final stage of the compressor K101.

One portion 433 of the crude secondary syngas product stream 416 is directly blended with the crude primary syngas product stream 417. Another second portion 434 of the crude secondary syngas product stream 416 is separated in a membrane separator 435 into a $H_2$-rich permeate 436 and a CO-enriched residual stream 437. The residual stream 437 is blended with the crude primary syngas product stream 417 to provide the primary syngas product 438 having a $H_2$:CO molar ratio of, for example, 1:1.

A second syngas product having a $H_2$:CO molar ratio, for example 2:1, higher than that of the primary syngas product 438 is provided by the portion 439 of the crude secondary syngas product remaining after removal of portions 433 and 434 from stream 416.

The $H_2$:CO molar ratio of the crude primary syngas product 417 is determined primarily by the temperature in phase separator C103, which in turn is determined by the temperature in first phase separator pot C101. The temperature of the feed stream 402 at the outlet of heat exchanger E102 is an approach to the vaporizing temperature of the feed 423 to the methane column 424 and this is a function of the operating pressure of that column 424. Thus, the pressure of column 424 provides rough control of the $H_2$:CO molar ratio of syngas product 417. Fine tuning of this syngas molar ratio is provided by controlling the amounts of portion 433 of the crude secondary syngas product stream 416 and of the CO-enriched membrane-separated stream 437.

The LIN-refrigerated cold box condensation cycles shown in FIGS. 5, 6 and 7 contain several variations for control of the H2:CO molar ratio of the relatively $H_2$-rich stream (2:1 syngas product) and for improving cold box stability under changing feed conditions. In all of these illustrated embodiments the expander refrigeration assembly is omitted and refrigeration is provided by the vaporization of a liquid nitrogen supply LIN in heat exchangers E102 and E101 to form a gaseous nitrogen stream GAN. The crude secondary syngas product 416 is provided by rewarming the first vapor stream 503 from the first phase separator C101 in heat exchangers E102 and E101. The entire fourth liquid stream 414 withdrawn from the separator C103 is fed to the hydrogen stripping column 419. This column operates at, for example, about 285 psig (1.95 MPag) as for the process of FIG. 4 but, as explained below, the operating pressure of the methane column 424 depends on the composition of the syngas feed 501, 601 and the desired composition of the $H_2$-rich crude secondary syngas product stream 416.

The $H_2$:CO molar ratio of the stream 416 is determined primarily by the temperature in phase separator C101. The temperature of the feed stream 402 at the outlet of heat exchanger E102 is an approach to the vaporizing temperature of the feed 423 to the methane column 424. This vaporising temperature is in turn controlled by the operating pressure of the methane column 424 through compressor K101 internal controls. Depending on the composition of the cold box feed 501, 601 and the composition requirements for the crude secondary syngas product stream 416, the operating pressure of the methane column 424 can vary over a range from about 50 psig (350 kPag) to about 200 psig (1.4 MPag). The lower the pressure, the colder the outlet to heat exchanger E102 and the more $H_2$-rich the first vapor stream 503 becomes and vice versa.

The hydrogen stripping column 419 can be operated at, for example, pressures from about 10–20 psi (70–140 kPa) above the methane column 424 up to about 400 psig (2.75 MPag). The specific pressure for a given application will depend on the heat balance in heat exchanger E102; lower pressures for the column 419 being used when there is more rewarming/vaporising duty relative to cooling condensing duty in heat exchanger E102.

FIG. 5 also differs from FIG. 4 in that an additional membrane separator 540 is located upstream of heat exchanger E101 to separate the feed syngas 401 into a residual relatively CO-rich stream 501, which provides the feed for the cryogenic separation, and a $H_2$-rich permeate 541, which is blended with the permeate from the downstream to provide a $H_2$-rich product stream 536. In addition to providing the benefits of CO-enrichment of the feed gas described in the prior art, the upstream membrane separator is present as a control feature in this embodiment. In particular, it operates to provide a constant $H_2$;CO feed composition to the cryogenic separation despite varying compositions of the feed 401. Thus, more $H_2$ can be permeated if the plant feed $H_2$:CO rises and less if it falls to maintain a constant $H_2$:CO molar ratio in the feed 501 to the heat exchanger E101. This allows more stable operation of the cryogenic separation with a constant CO partial condensation duty at a constant CO production rate. Similarly, the composition of the feed 501 can be varied to make more or less CO product in a managed way as needed.

FIG. 6 differs from FIG. 5 in that there is no upstream membrane separator but a by-pass portion 641 of the syngas feed 401 is blended with the crude primary syngas product stream 417 and the remainder 601 is feed to the heat exchanger E101.

FIG. 7 differs from FIG. 6 in that a portion 733 of the by-pass feed syngas stream 641 is directly blended with the crude primary syngas product stream 417 and the remainder of the by-pass feed stream is fed to a membrane separator 735 instead of a portion of the crude secondary syngas product stream. This membrane separator 735 provides a $H_2$-rich permeate 736 and a CO-enriched residual stream 737 for blending with the crude primary syngas product stream 417

The amount of syngas by-pass 641 in FIGS. 6 and 7 is variable and is controlled to maintain a constant, stable carbon monoxide production rate in the face of widely varying $H_2$:CO molar ratios in the syngas feed. The basis for this control is that the primary heat transfer duty in a condensation cycle separation without integrated cryogenic nitrogen removal from carbon monoxide product is the initial condensation of carbon monoxide from the feed stream 601. The amount of carbon monoxide condensed from this feed stream is directly proportional to the amount of pure carbon monoxide 427 produced by the cryogenic separation because the carbon monoxide recovery in the downstream processing in the cryogenic separation is relatively constant. By coupling the feed flow 601 to the product carbon monoxide level in feedback control, a roughly constant carbon monoxide condensing duty in the feed stream 601 can be maintained even if the $H_2$:CO molar ratio in the feed changes dramatically. Thus, a sudden jump to higher carbon monoxide concentration in the feed 601 would cascade forward to produce a temporary excess of carbon monoxide product 427 which would act through the control to lower the feed flow rate 601 and to bring the carbon monoxide production (and primary heat transfer duty) back to normal. The reverse control action would apply for sudden drops in carbon monoxide concentration feed 601. The cryogenic separation would thus remain stable in both primary heat transfer duty and production levels despite otherwise unmanageable variations in the composition of the feed 601. Similarly, this bypass control can be used to make more or less carbon monoxide product 427 in a managed way as needed.

Any resulting composition or flow variation induced in the primary syngas product stream 438 in FIG. 6 (and FIG. 7) resulting from the direct blending of (a portion 733 of the bypass feed 641 with the crude primary syngas product stream 417 can be adequately addressed by the integrated membrane control system.

In all of the illustrated embodiments, It is possible to feed the $H_2$-rich permeate stream 436, 536, 736 (compressed if necessary) to a pressure swing adsorption device to provide a final, more pure, $H_2$ product stream.

An additional variation, not shown in the Figures, is to replace the membrane separator 435, 735 with an alternative hydrogen rejection system such as a pressure swing adsorption device with a purge or equalisation gas compressor present as needed. The compressed purge or equalisation gas would then constitute the carbon monoxide enriched control stream 437, 737. This option would be useful when a high pressure $H_2$ product stream is required and the purge/equalisation gas compression requirement is small relative to a permeate compressor for the equivalent membrane case.

The invention, in its different embodiments, is capable of providing an overall carbon monoxide recovery of greater than 98% based on the available feed and the required products. The following Tables 1 to 4 summarise the overall mass balance and LIN consumption for each of the embodiments shown in FIGS. 4 to 7 respectively.

TABLE 1

FIG. 4 Expander Refrigerated Option

| Stream | | CO Pro- | Seal Los- | 1:1 Syn- | 2:1 Syn- | | Fuel | |
|---|---|---|---|---|---|---|---|---|
| Comp. | Units | Feed | duct | ses | gas | gas | Perm | Gas |
| $H_2$ | mol % | 52.3 | 0.005 | 0.005 | 49.7 | 66.3 | 97.8 | — |
| $N_2$ | mol % | 0.5 | 0.8 | 0.8 | 0.6 | 0.4 | — | 0.1 |
| CO | mol % | 47.0 | 98.8 | 98.8 | 49.6 | 33.2 | 2.1 | 63.3 |
| Ar | mol % | 0.15 | 0.4 | 0.4 | 0.2 | 0.1 | — | 1.3 |
| $CH_4$ | ppm | 500 | 5 | 5 | 300 | 140 | 3 | 35.4% |
| Flow | lbmole/h | 10000 | 1000 | 15 | 5710 | 2550 | 710 | 8 |
| | kgmol/h | 4536 | 454 | 6.8 | 2590 | 1157 | 322 | 3.6 |
| Pressure | psia | 805 | 665 | | 515 | 792 | 105 | 165 |
| | MPa | 5.55 | 4.585 | | 3.55 | 5.46 | 0.725 | 1.14 |
| Temp. | ° F. | 50 | 100 | | 49 | 46 | 50 | 50 |
| | ° C. | 10 | 37.8 | | 9.4 | 7.8 | 10 | 10 |
| CO Recov* | % | | | | 99.2 | | | |

*CO recovery based on CO, 1:1, and 2:1 syngas products only.

TABLE 2

FIG. 5 Refrigerated Option with Auxiliary Feed Membrane

| Stream | | CO Pro- | Seal Los- | 1:1 Syn- | 2:1 Syn- | | Fuel | |
|---|---|---|---|---|---|---|---|---|
| Comp. | Units | Feed | duct | ses | gas | gas | Perm | Gas |
| $H_2$ | mol % | 61.0 | 0.005 | 0.005 | 49.5 | 66.3 | 97.8 | — |
| $N_2$ | mol % | 0.5 | 1.0 | 1.0 | 0.7 | 0.5 | — | 0.1 |
| CO | mol % | 38.3 | 98.5 | 98.5 | 49.6 | 33.1 | 2.1 | 55.0 |
| Ar | mol % | 0.15 | 0.4 | 0.4 | 0.2 | 0.1 | — | 1.5 |
| $CH_4$ | ppm | 500 | 5 | 5 | 360 | 250 | 7 | 43.4% |
| Flow | lbmole/h | 10000 | 1012 | 15 | 2420 | 4750 | 1790 | 7 |
| | kgmol/h | 4536 | 459 | 6.8 | 1098 | 2155 | 812 | 3.2 |
| Pressure | psia | 805 | 665 | | 515 | 786 | 105 | 105 |
| | MPa | 5.55 | 4.585 | | 3.55 | 5.420 | 0.725 | 0.725 |
| Temp. | ° F. | 50 | 100 | | 49 | 46 | 50 | 46 |
| | ° C. | 10 | 37.8 | | 9.4 | 7.8 | 10 | 7.8 |
| CO Recov* | % | | | | 98.5 | | | |
| LIN Use | lbmole/h | | | | 87 | | | |
| | kgmol/h | | | | 39.5 | | | |

*CO recovery based on CO, 1:1, and 2:1 syngas products only.

TABLE 3

FIG. 6 LIN Refrigerated Option with Feed Bypass Control

| Stream | | CO Pro- | Seal Los- | 1:1 Syn- | 2:1 Syn- | | Fuel | |
|---|---|---|---|---|---|---|---|---|
| Comp. | Units | Feed | duct | ses | gas | gas | Perm | Gas |
| $H_2$ | mol % | 52.3 | 0.005 | 0.005 | 49.7 | 66.3 | 97.9 | — |
| $N_2$ | mol % | 0.5 | 0.9 | 0.9 | 0.5 | 0.4 | — | 0.1 |
| CO | mol % | 47.0 | 98.8 | 98.8 | 49.6 | 33.2 | 2.1 | 76.0 |
| Ar | mol % | 0.15 | 0.3 | 0.3 | 0.2 | 0.1 | — | 1.4 |
| $CH_4$ | ppm | 500 | 5 | 5 | 460 | 160 | 3 | 22.5% |
| Flow | lbmole/h | 10000 | 1000 | 14 | 5970 | 2160 | 850 | 8 |
| | kgmol/h | 4536 | 454 | 6.4 | 2708 | 980 | 386 | 3.6 |
| Pressure | psia | 805 | 665 | | 515 | 797 | 105 | 105 |
| | MPa | 5.55 | 4.585 | | 3.55 | 5.495 | 0.725 | 0.725 |
| Temp. | ° F. | 50 | 100 | | 49 | 49 | 50 | 49 |
| | ° C. | 10 | 37.8 | | 9.4 | 9.4 | 10 | 9.4 |
| CO Recov* | % | | | | 99.2 | | | |
| LIN Use | lbmole/h | | | | 30 | | | |
| | kgmol/h | | | | 13.6 | | | |

*CO recovery based on CO, 1:1, and 2:1 syngas products only.

TABLE 4

FIG. 7 LIN Refrigerated Option with Feed Membrane

| Stream | | CO Pro- | Seal Los- | 1:1 Syn- | 2:1 Syn- | | Fuel | |
|---|---|---|---|---|---|---|---|---|
| Comp. | Units | Feed | duct | ses | gas | gas | Perm | Gas |
| $H_2$ | mol % | 52.3 | 0.005 | 0.005 | 49.6 | 66.3 | 96.8 | — |
| $N_2$ | mol % | 0.5 | 0.9 | 0.9 | 0.5 | 0.4 | — | 0.1 |
| CO | mol % | 47.0 | 98.8 | 98.8 | 49.6 | 33.2 | 3.2 | 76.1 |
| Ar | mol % | 0.15 | 0.3 | 0.3 | 0.2 | 0.1 | — | 1.4 |
| $CH_4$ | ppm | 500 | 5 | 5 | 500 | 160 | 11 | 22.4% |
| Flow | lbmole/h | 10000 | 1000 | 14 | 5010 | 3600 | 370 | 9 |
| | lkgmol/h | 4536 | 454 | 6.4 | 2273 | 1633 | 168 | 4.1 |
| Pressure | psia | 805 | 665 | | 515 | 797 | 105 | 105 |
| | MPa | 5.55 | 4.585 | | 3.55 | 5.495 | 0.725 | 0.725 |
| Temp. | ° F. | 50 | 100 | | 49 | 49 | 50 | 49 |
| | ° C. | 10 | 37.8 | | 9.4 | 9.4 | 10 | 9.4 |
| CO Recov* | % | | | | 99.3 | | | |
| LIN Use | lbmole/h | | | | 30 | | | |
| | kgmol/h | | | | 13.6 | | | |

*CO recovery based on CO, 1:1, and 2:1 syngas products only.

The invention has the following benefits over the existing technology for the separation of syngas to provide a product containing hydrogen and carbon monoxide with a predetermined $H_2$:CO molar ratio:

The most important benefit is the precise control of primary syngas product composition and flow in the face of changing feed compositions and product requirements. The invention allows syngas composition control through blending more or less of either the relatively $H_2$-rich blend stream 416 from the cryogenic separation or the CO enriched stream 437, 737 from the membrane separator 435, 735. The invention allows flow control through the ability to increase or decrease the flow of the two blend streams 416; 437, 737 in tandem, maintaining a constant composition as the total flow of primary product syngas 438 is varied. In addition, enough membrane surface can be provided to completely shift the $H_2$-rich stream flow (except the $H_2$ permeate) to provide more primary syngas product. This additional membrane area can also be refit simply into an existing system without the high cost and long down time associated with cold box modifications.

A second key benefit of the invention is its ability to reject a $H_2$ stream containing minimal carbon monoxide (permeate product) without the use of a cryogenic cold end sub-system. This significantly reduces both power and capital cost of the overall plant.

The main benefit of the methane column pressure control of the composition of the relatively $H_2$-rich syngas stream is the additional degree of freedom in production capability. This allows a partial condensation plant to flexibly adjust its product slate depending on feed material balance or changing production requirements. As shown in FIGS. 5 to 7, two separate $H_2$:CO syngas product streams can be controlled in composition independently of each other in a simple and efficient manner.

The main benefit of the feed membrane control in FIG. 5 and the cryogenic process bypass control in FIGS. 6 and 7 is the increased ability of the plant to maintain stable cryogenic operation with respect to its major heat loads in the face of changes in syngas feed $H_2$:CO molar ratio. In addition, these control features allow more stable management of carbon monoxide production to permit well controlled increases or decreases in carbon monoxide product flow rates.

It will be understood by those skilled in the art that the invention is not restricted to the specific details described above and that numerous modifications and variations can be made without departing from the scope and equivalence of the following claims.

What is claimed is:

1. A process for the separation of a feed gas mixture containing at least 90% of two components A and B to provide at least one product gas mixture of variable molar ratio between said components A and B, wherein:

at least part of the feed gas mixture is cryogenically separated by partially condensation into a vapor phase enriched in component A and a liquid phase enriched in component B;

a first gas mixture containing said components in a first A:B molar ratio is obtained from said liquid phase and a second gas mixture containing said components in a higher A:B molar ratio than said first molar ratio is obtained from said vapor phase;

at least one gas mixture selected from the group consisting of at least a portion of said feed gas mixture and at least a portion of said second gas mixture is subjected to non-cryogenic separation to provide a separated gas rich in component B; and said separated gas rich in component B is added to said first gas mixture to change the A:B molar ratio of said first gas mixture and to contribute to contribute to said product gas mixture.

2. The process according to claim 1, wherein said non-cryogenic separation is membrane separation.

3. The process according to claim 1, wherein a portion of said second gas mixture is subjected to said non-cryogenic separation.

4. The process according to claim 1, wherein a portion of said feed gas mixture is subjected to said non-cryogenic separation.

5. The process according to claim 1, wherein a portion of said second gas mixture, other than any portion of said second gas mixture subjected to said non-cryogenic separation, is added to said first gas mixture to further vary the molar ratio of said product gas mixture.

6. The process according to claim 1, wherein a portion of said feed gas mixture, other than any portion of said feed gas mixture subjected to said non-cryogenic separation, is added to said first gas mixture to further vary the molar ratio of said product gas mixture.

7. The process according to claim 1, wherein said liquid phase is partially vaporized to provide a residual liquid phase and a vaporized phase; said residual liquid phase is fractionated to provide a gaseous stream enriched in component A and a liquid stream enriched in component B; and said first gas mixture is derived from said vaporized phase and said gaseous stream.

8. The process according to claim 1, wherein at least a portion of the feed gas mixture has been subjected to membrane separation upstream of the cryogenic separation.

9. The process according to claim 1, wherein the feed gas mixture comprises hydrogen and carbon monoxide; said mixtures contain at least 90% hydrogen and carbon monoxide; and said common component is carbon monoxide.

10. A process for the separation of a feed gas mixture containing hydrogen and carbon monoxide to provide at least one product gas mixture containing hydrogen and carbon monoxide in a different molar ratio to said feed gas mixture, wherein:

at least a portion of the feed gas mixture is cryogenically separated by partial condensation to provide a hydrogen-enriched vapor phase and a carbon monoxide-enriched liquid phase;

a first gas mixture containing hydrogen and carbon monoxide in a first $H_2$:CO molar ratio is obtained from said carbon monoxide-enriched liquid phase and a second gas mixture containing hydrogen and carbon monoxide in a higher $H_2$:CO molar ratio than said first gas mixture is obtained from said hydrogen-enriched vapor phase;

at least a portion of said second gas mixture is subjected to non-cryogenic separation to provide a carbon monoxide-rich gas; and said carbon monoxide-rich gas is added to said first gas mixture to contribute to said product gas mixture.

11. The process according to claim 10 wherein said non-cryogenic separation is membrane separation.

12. The process according to claim 10, wherein a portion of said second gas mixture is added to said first gas mixture.

13. The process according to claim 10, wherein a portion of said feed gas mixture is added to said first gas mixture.

14. The process according to claim 10, wherein said carbon monoxide-enriched liquid phase is partially vaporized to provide a residual liquid phase and a vaporized phase; said residual liquid phase is fractionated to provide a gaseous stream of increased hydrogen concentration and a liquid stream of increased carbon monoxide concentration; and said first gas mixture is derived from said vaporized phase and said gaseous stream.

15. The process according to claim 10, wherein at least a portion of the feed gas mixture has been subjected to membrane separation upstream of the cryogenic separation.

16. A process for the separation of a feed gas mixture containing hydrogen and carbon monoxide to provide at least one product gas mixture containing hydrogen and carbon monoxide in a different molar ratio to said feed gas mixture, wherein:

at least a portion of the feed gas mixture is cryogenically separated by partial condensation to provide a hydrogen-enriched vapor phase and a carbon monoxide-enriched liquid phase; a first gas mixture containing hydrogen and carbon monoxide in a first $H_2$:CO molar ratio is obtained from said carbon monoxide-enriched liquid phase and a second gas mixture containing hydrogen and carbon monoxide in a higher $H_2$:CO molar ratio than said first gas mixture is obtained from said hydrogen-enriched vapor phase;

at least a portion of said feed gas mixture is subjected to non-cryogenic separation to provide a carbon monoxide-rich gas; and said carbon monoxide-rich gas is added to said first gas mixture to contribute to said product gas mixture.

17. The process according to claim 16, wherein said non-cryogenic separation is membrane separation.

18. The process according to claim 16, wherein a portion of said second gas mixture is added to said first gas mixture.

19. The process according to claim 16, wherein a portion of said feed gas mixture is added to said first gas mixture.

20. The process according to claim 16, wherein said carbon monoxide-enriched liquid phase is partially vaporized to provide a residual liquid phase and a vaporized phase; said residual liquid phase is fractionated to provide a gaseous stream of increased hydrogen concentration and a liquid stream of increased carbon monoxide concentration; and said first gas mixtures is derived from said vaporized phase and said gaseous stream.

21. An apparatus for the separation of a feed gas mixture containing at least 90% of two components A and B to provide at least one product gas mixture of variable molar ratio between said components A and B, comprising;

a cryogenic separator comprising a heat-exchanger for partially condensing at least a portion of the feed gas stream to provide a vapor phase enriched in component A and a liquid phase enriched in component B;

a phase separator for separating said vapor and liquid phases;

a first processing assembly for obtaining from said liquid phase a first gas mixture containing said components in a first A:B molar ratio;

a second processing assembly for obtaining from said vapor phase a second gas mixture containing said components in a higher A:B molar ratio than said first molar ratio;

a non-cryogenic separator for separating at least one gas mixture selected from the group consisting of at least a portion of said feed gas mixture and at least a portion of said second gas mixture to provide a separated gas enriched in component B; and a conduit assembly for adding said separated gas to said first gas mixture to change the A:B molar ratio of said first gas mixture and contribute to the product gas mixture.

22. The apparatus according to claim 21, wherein said non-cryogenic separator is a membrane separator.

23. The apparatus according to claim 21, further comprising a conduit assembly for adding a portion of said second gas mixture to said first gas mixture.

24. The apparatus according to claim 21, further comprising a conduit assembly for adding a portion of said feed gas mixture to said first gas mixture.

25. The apparatus according to claim 21, wherein said first processing assembly further comprises a device for partially vaporizing said liquid phase to provide a residual liquid phase and a vaporized phase; a fractionator for fractionating said residual liquid phase to provide a gaseous stream enriched in component A and a liquid stream enriched in component B; and a processing sub-assembly for obtaining said first gas mixture from said vaporized phase and said gaseous stream.

26. An apparatus for the separation of a feed gas mixture containing hydrogen and carbon monoxide to provide at least one product gas mixture containing hydrogen and carbon monoxide in a different molar ratio to said feed gas mixture, comprising:

a heat exchanger for partially condensing at least a portion of the feed gas mixture in a cryogenic cold box to provide a hydrogen-enriched vapor phase and a carbon monoxide-enriched liquid phase;

a phase separator for separating said vapor and liquid phases;

a first processing assembly for obtaining from said liquid phase a first gas mixture containing hydrogen and carbon monoxide in a first $H_2$:CO molar ratio;

a second processing assembly for obtaining from said vapor phase a second gas mixture containing hydrogen and carbon monoxide in a higher $H_2$:CO molar ratio than said first gas mixture;

a non-cryogenic separator for separating at least a portion of said second gas mixture to provide a carbon monoxide-rich gas; and a conduit assembly for adding said carbon monoxide-rich gas to said first gas mixture.

27. The apparatus according to claim 26, wherein said non-cryogenic separator is a membrane separator.

28. The apparatus according to claim 26, further comprising a conduit assembly for adding a portion of said second gas mixture to said first gas mixture.

29. The apparatus according to claim 26, further comprising a conduit assembly for adding a portion of said feed gas mixture to said first gas mixture.

30. The apparatus according to claim 26, wherein said first processing assembly further comprises a device for partially vaporizing said liquid phase to provide a residual liquid phase and a vaporized phase; a fractionator for fractionating said residual liquid phase to provide a gaseous stream enriched in lighter components and a liquid stream enriched in heavier components; and a processing sub-assembly for obtaining said first gas mixtures from said vaporized phase and said gaseous stream.

31. An apparatus for the separation of a feed gas mixture containing hydrogen and carbon monoxide to provide at least one product gas mixture containing hydrogen and carbon monoxide in a different molar ratio to said feed gas mixture, comprising:

a heat exchanger for partially condensing at least a portion of the feed gas mixture in a cryogenic cold box to provide a hydrogen-enriched vapor phase and a carbon monoxide-enriched liquid phase;

a phase separator for separating said vapor and liquid phases;

a first processing assembly for obtaining from said liquid phase a first gas mixture containing hydrogen and carbon monoxide in a first $H_2$:CO molar ratio;

a second processing assembly for obtaining from said vapor phase a second gas mixture containing hydrogen and carbon monoxide in a higher $H_2$:CO molar ratio than said first gas mixture;

a non-cryogenic separator for separating at least a portion of said feed gas mixture to provide a carbon monoxide-rich gas; and a conduit assembly for adding said carbon monoxide-rich gas to said first gas mixture.

32. The apparatus according to claim 31, wherein said non-cryogenic separator is a membrane separator.

33. The apparatus according to claim 31, further comprising a conduit assembly for adding a portion of said second gas mixture to said first gas mixture.

34. The apparatus according to claim 31, further comprising a conduit assembly for adding a portion of said feed gas mixture to said first gas mixture.

35. The apparatus according to claim 31, wherein said first processing assembly further comprises a device for partially vaporizing said liquid phase to provide a residual liquid phase and a vaporized phase; a fractionator for fractionating said residual liquid phase to provide a gaseous stream enriched in lighter components and a liquid stream enriched in heavier components; and a processing sub-assembly for obtaining said first gas mixture from said vaporized phase and said gaseous stream.

36. A process for the separation of a feed gas mixture containing at least 90% of hydrogen and carbon monoxide to provide at least one product gas of variable $H_2$:CO molar ratio, wherein:

at least part of the feed gas mixture is separated by cryogenic separation into at least a first gas mixture containing hydrogen and carbon monoxide in a first $H_2$:CO molar ratio and a second gas mixture containing hydrogen and carbon monoxide in a higher $H_2$:CO molar ratio than said first molar ratio;

at least one gas mixture selected from the group consisting of at least a portion of said feed gas mixture and at least a portion of said second gas mixture is subjected to non-cryogenic separation to provide a separated gas rich in carbon monoxide; and said separated gas rich in carbon monoxide is added to said first gas mixture in an amount to vary the $H_2$:CO molar ratio of said product gas mixture.

37. A process for the separation of a feed gas mixture containing at least 90% of components A and B to provide at least one product gas mixture containing components A and B in a different molar ratio to said feed gas mixture, wherein:

at least a portion of the feed gas mixture is cryogenically separated by partial condensation to provide a vapor phase enriched in component A and a liquid phase enriched in component B;

a first gas mixture containing components A and B in a first A:B molar ratio is obtained from said liquid phase and a second gas mixture containing components A and B in a higher A:B molar ratio than said first gas mixture is obtained from said vapor phase;

at least a portion of said second gas mixture is subjected to non-cryogenic separation to provide a gas rich in component B; and said gas rich in component B is added to said first gas mixture to change the A:B the molar ratio of said first gas mixture and to contribute to said product gas mixture.

38. A process for the separation of a feed gas mixture containing at least 90% of components A and B to provide at least one product gas mixture containing components A and B in a different A-B molar ratio to said feed gas mixture, wherein:

at least a portion of the feed gas mixture is cryogenically separated by partial condensation to provide a vapor phase enriched in component A and a liquid phase enriched in component B; a first gas mixture containing components A and B in a first A:B molar ratio is obtained from said liquid phase and a second gas mixture containing components A and B in a higher A:B molar ratio than said first gas mixture is obtained from said vapor phase;

at least a portion of said feed gas mixture is subjected to non-cryogenic separation to provide a gas rich in component B; and said gas rich in component B is added to said first gas mixture to change the A:B molar ratio of the first gas mixture and to contribute to said product gas mixture.

* * * * *